US009946182B2

(12) United States Patent
Murakami et al.

(10) Patent No.: US 9,946,182 B2
(45) Date of Patent: Apr. 17, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Tsuyoshi Murakami, Kanagawa (JP); Atsushi Sugawara, Kanagawa (JP); Kana Yoshida, Kanagawa (JP); Masaki Iwase, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/425,215

(22) Filed: Feb. 6, 2017

(65) Prior Publication Data

US 2018/0067414 A1 Mar. 8, 2018

(30) Foreign Application Priority Data

Sep. 7, 2016 (JP) ..... 2016-175018

(51) Int. Cl.

| | |
|---|---|
| ***G03G 9/09*** | (2006.01) |
| ***G03G 9/08*** | (2006.01) |
| ***G03G 9/087*** | (2006.01) |
| ***G03G 15/08*** | (2006.01) |

(52) U.S. Cl.

CPC ..... *G03G 9/0902* (2013.01); *G03G 9/0819* (2013.01); *G03G 9/0825* (2013.01); *G03G 9/0827* (2013.01); *G03G 9/08711* (2013.01); *G03G 9/08755* (2013.01); *G03G 9/0904* (2013.01); *G03G 15/0865* (2013.01)

(58) Field of Classification Search

CPC .. G03G 9/0902; G03G 9/0926; G03G 9/0825; G03G 9/0827

USPC ..... 430/110.1

See application file for complete search history.

(56) References Cited

U.S. PATENT DOCUMENTS 8,293,440 B2 * 10/2012 Nakamura ..... G03G 9/0806 430/107.1

FOREIGN PATENT DOCUMENTS

| | | | |
|---|---|---|---|
| JP | 2002-108021 | A | 4/2002 |
| JP | 2006-317601 | A | 11/2006 |

* cited by examiner

*Primary Examiner* — Janis L Dote
(74) *Attorney, Agent, or Firm* — Oliff PLC

(57) ABSTRACT

An electrostatic charge image developing toner includes toner particles including a binder resin and a white pigment, wherein a maximum frequent value in distribution of eccentricity B of the white pigment represented by the following Expression (1) is from 0.75 to 0.95, and a skewness in the distribution of the eccentricity B is from −1.20 to 0.00: Expression (1): eccentricity B=2d/D, wherein D represents an equivalent circle diameter (μm) of a toner particle in observation of the cross section of the toner particle, and d represents a distance (μm) from the centroid of the toner particle to the centroid of the white pigment in observation of the cross section of the toner particle.

12 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-175018 filed Sep. 7, 2016.

BACKGROUND

1. Technical Field

The present invention relates to an electrostatic charge image developing toner, an electrostatic charge image developer, and a toner cartridge.

2. Related Art

In the image formation according to the electrophotographic system, a toner is used as an image forming material, and for example, a toner which includes toner particles containing a binder resin, a release agent, and a colorant, and an external additive which is externally added to the toner particles, is widely used.

A technology utilizing a toner has been known in the image formation according to the electrophotographic system so far.

SUMMARY

According to an aspect of the invention, there is provided an electrostatic charge image developing toner, including:

toner particles including a binder resin and a white pigment, wherein a maximum frequent value in distribution of eccentricity B of the white pigment represented by the following Expression (1) is from 0.75 to 0.95, and a skewness in the distribution of the eccentricity B is from −1.20 to 0.00:

$$\text{eccentricity } B=2d/D \qquad \text{Expression(1):}$$

wherein D represents an equivalent circle diameter (μm) of a toner particle in observation of the cross section of the toner particle, and d represents a distance (μm) from the centroid of the toner particle to the centroid of the white pigment in observation of the cross section of the toner particle.

BRIEF DESCRIPTION OF THE DRAWINGS

Exemplary embodiments of the present invention will be described in detail based on the following figures, wherein.

DETAILED DESCRIPTION

Figure 1:
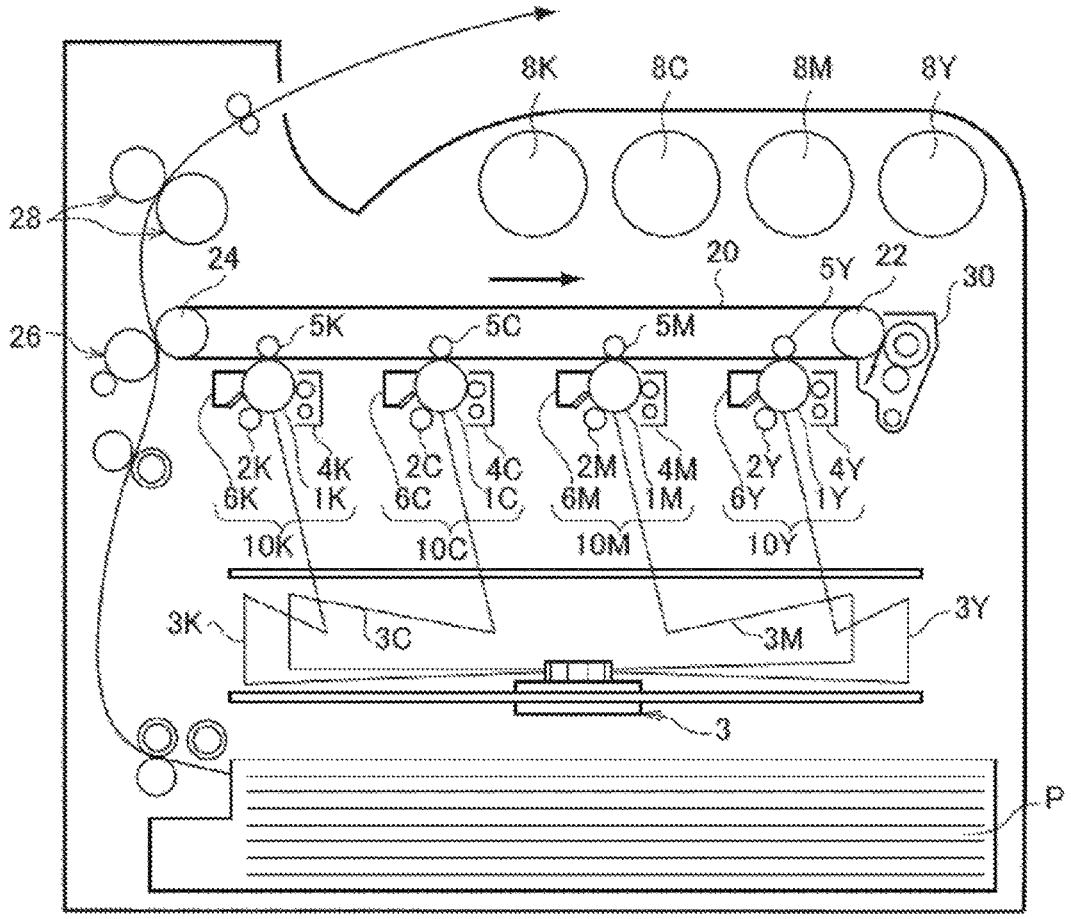
FIG. 1 is a schematic configuration diagram showing an example of an image forming apparatus according to this exemplary embodiment.

Hereinafter, exemplary embodiments will be described in detail.

Electrostatic Charge Image Developing Toner

An electrostatic charge image developing toner (also simply referred to as a "toner") according to this exemplary embodiment includes toner particles including a binder resin and a white pigment, a maximum frequent value in distribution of eccentricity B of the white pigment represented by the following Expression (1) is 0.75 to 0.95, and a skewness in the distribution of the eccentricity B is −1.20 to 0.00.

$$\text{eccentricity } B=2d/D \qquad \text{Expression (1):}$$

In Expression (1), D represents an equivalent circle diameter (μm) of a toner particle in observation of the cross section of the toner particle, and d represents a distance (μm) from the centroid of the toner particle to the centroid of the white pigment in observation of the cross section of the toner particle.

With the configurations described above, the electrostatic charge image developing toner according to this exemplary embodiment exhibits excellent concealing properties and laminating properties of an image to be obtained. The reason thereof is not clear, but the following reason is assumed.

In recent years, a test regarding printing with respect to a recording medium such as a label or a film is performed, in order to improve an added value of an image obtained by using electrophotography. Labels and films are different from paper of the related art and a material thereof is transparent or colored, in many cases. Accordingly, in a case of using four color toners, for example, a yellow toner, a magenta toner, a cyan toner, and a black toner, as they are, color reproduction may be deteriorated.

Therefore, a base of a color image is formed using a white toner as a fifth toner, and color reproduction is improved. The white toner in this case is required to have excellent concealing properties as a base, and the concealing properties are exhibited when incident light is not transmitted through the base and is scattered on and reflected by the base. The excellent concealing properties are realized, when incident light is sufficiently scattered in an image.

Meanwhile, a label or a film on which an image is formed may be subjected to laminating as post-processing after image printing. In this case, when a pigment is exposed to the surface of the image, adhesiveness of a laminate film is deteriorated, and laminating properties are deteriorated.

Therefore, in this exemplary embodiment, an optimal structure in which the white pigment is provided to be close to a surface layer of the toner particles as much as possible and the exposure of the white pigment to the surface of the toner particle is prevented is provided. Specifically, in the toner particles, when a maximum frequent value in distribution of eccentricity B of the white pigment represented by Expression (1) is 0.75 to 0.95 and skewness in the distribution of the eccentricity B is −1.20 to 0.00, it is possible to prevent exposure of the white pigment to a surface of an image and dispose the white pigment in a high concentration in the vicinity of the surface of the image, and an image satisfying both excellent concealing properties and laminating properties is formed.

The maximum frequent value in distribution of the eccentricity of the white pigment indicates a value at a portion where concentration of the white pigment is highest in a depth direction of the toner particle, and as the value is large, a large amount of white pigment is in a portion close to a toner outer peripheral portion. The skewness in the distribution of the eccentricity of the white pigment indicates a deviation in distribution of a concentration gradient of the white pigment in a depth direction of the toner particle, and the value thereof which is 0, indicates normal distribution.

As the value thereof is small in Expression (1), the concentration of the white pigment is biased to the vicinity of the outer periphery of the toner.

Hereinafter, the electrostatic charge image developing toner according to the exemplary embodiment will be described in detail.

In the electrostatic charge image developing toner according to the exemplary embodiment, the maximum frequent value in distribution of the eccentricity B of the white pigment represented by Expression (1) is 0.75 to 0.95, and is preferably 0.78 to 0.92, more preferably 0.80 to 0.90, and even more preferably 0.82 to 0.88, from viewpoints of concealing properties and laminating properties of an image to be obtained.

In the electrostatic charge image developing toner according to the exemplary embodiment, the skewness in the distribution of the eccentricity B of the white pigment represented by Expression (1) is −1.20 to 0.00, and is preferably −1.20 to −0.25, more preferably −1.20 to −0.50, and even more preferably −1.00 to −0.60, from viewpoints of concealing properties and laminating properties of an image to be obtained.

When the skewness in the distribution of the eccentricity B of the white pigment represented by Expression (1) is −1.20 to −0.50, the white pigment is unevenly distributed in a range of the eccentricity B equal to or greater than 0 and smaller than 0.75, that is, the white pigment is present with a decreased amount towards the centroid, even in a portion where a large amount of the white pigment is included which is from the centroid of the toner particle to the toner particle outer periphery portion.

When the white pigment is distributed as described above, laminating properties and gloss uniformity of a white image are excellent. The reason of exhibiting the result is considered as follows.

In a case where the skewness in the distribution of the eccentricity B of the white pigment is equal to or smaller than −1.20, a large amount of the white pigment is disposed in the toner, and melting of the toner at the time of fixation easily becomes insufficient due to a network effect of the pigment. Accordingly, smoothness of an image after the fixation is not sufficient, and adhesiveness with respect to a laminated image easily becomes insufficient. Meanwhile, when the skewness in the distribution of the eccentricity B of the white pigment is equal to or greater than 0.00, a network effect of the pigment in the toner is prevented, but an excessively large amount of the pigment is present in a certain region, and thus, bleeding of a release agent from the inner portion of the toner is prevented. Accordingly, minute roughness occurs on the a front end portion in the image peeling at the time of fixation, and adhesiveness with respect to a laminated image easily becomes insufficient, in the same manner as described above.

A measuring method of the eccentricity B of the white pigment will be described.

First, after embedding the toner particles using a bisphenol A-type liquid epoxy resin and a hardening agent, a cutting sample is prepared. Then, the cutting sample is cut at −100° C. by using a cutter using a diamond knife, for example, LEICA ULTRAMICROTOME (manufactured by Hitachi High-Technologies Corporation), and an observation sample is prepared. If necessary, this observation sample is kept in a desiccator which is in a ruthenium tetroxide environment, and dyeing is performed. The determination of dyeing is performed with a degree of dyeing of a tape kept at the same time. The observation sample obtained as described above is observed with a scanning transmission electron microscope (STEM).

First, an image is recorded at magnification which allows a cross section of one toner particle to come in sight. Image analysis for the recorded image is performed under a condition of 0.010000 μm/pixel, by using image analysis software (WinROOF manufactured by MITANI Corporation). A shape of the cross section of the toner particle is extracted by this image analysis by using a brightness difference (contrast) between the epoxy resin used in embedding and the binder resin of the toner particle. A projected area is obtained based on the extracted shape of the cross section of the toner particle. An equivalent circle diameter is obtained from the projected area. An equivalent circle diameter is calculated by an expression of $2\sqrt{(\text{projected area}/\pi)}$. The obtained equivalent circle diameter is set as an equivalent circle diameter D of the toner particle in observation of the cross section of the toner particle.

Meanwhile, a centroid position is obtained based on the extracted shape of the cross section of the toner particle. Subsequently, a shape of the cross section of the white pigment is extracted by using a brightness difference (contrast) between the binder resin and the release agent, and the white pigment, and a centroid position of the shape of the cross section of the white pigment is obtained. Each of the centroid positions is obtained as follows. x coordinates of the centroids are values obtained by dividing summation of $x_i$ coordinate values by n, and y coordinates of the centroids are values obtained by dividing summation of $y_i$ coordinate values by n, when the number of pixels in an area of the extracted toner particle or the extracted white pigment is set as n, and xy coordinates of each pixel are set as $x_i$ and $y_i$ (i=1, 2, . . . , n). A distance between the centroid position of the cross section of the toner particle and the centroid position of the shape of the cross section of the white pigment is obtained. The obtained distance is set as a distance d from the centroid of the toner particle to the centroid of the shape of the cross section of the white pigment in observation of the cross section of the toner particle.

At last, the eccentricity B of the white pigment is obtained based on each of the equivalent circle diameter D and the distance d by using Expression (1) (eccentricity B=2d/D). Similarly, the above-described operation is performed on each of plural white pigments in the cross section of one toner particle, and thereby the eccentricity B of the white pigment is obtained.

Next, a calculating method of the maximum frequent value in distribution of the eccentricity B of the white pigment will be described.

First, the eccentricity B of the white pigment described above is measured for 200 toner particles. Data of the obtained eccentricity B of each of the white pigments is subjected to statistical analysis processing in a data sections from 0 in increment of 0.01, and thereby the distribution of the eccentricity B is obtained. The maximum frequent value in the obtained distribution, that is, a value of a data section which appears most in the distribution of the eccentricity B of the white pigment is obtained. The value of this data section is set as the maximum frequent value in the distribution of the eccentricity B of the white pigment.

Next, a calculating method of the skewness in the distribution of the eccentricity B of the white pigment will be described.

First, the distribution of the eccentricity B of the white pigment is obtained as described above. The skewness in the distribution of the eccentricity B is obtained based on the following expression. In the following expression, the skewness is set as Sk, the number of pieces of data of the eccentricity B of the white pigment is set as n, values of data of the eccentricity B of the respective white pigments are set as $x_i$ (i=1, 2, . . . , n), an average value of all pieces of data of the eccentricity B of the white pigment is set as x (x with a bar above), and a standard deviation of all pieces of data of the eccentricity B of the white pigment is set as s.

$$Sk = \frac{n}{(n-1)(n-2)} \sum_{i=1}^{n} \left( \frac{x_i - \bar{x}}{s} \right)^3 \quad \text{Expression 1}$$

A method for satisfying distribution characteristics of the eccentricity B of the white pigment in the electrostatic charge image developing toner according to this exemplary embodiment will be described in a manufacturing method of an electrostatic charge image developing toner which will be described later.

In the electrostatic charge image developing toner according to this exemplary embodiment, the amount of the white pigment on the surface of the toner particle is preferably 0.05% by weight to 1.50% by weight, more preferably 0.06% by weight to 1.20% by weight, and particularly preferably 0.07% by weight to 1.00% by weight, in terms of a weight proportion of elements on the surface, that is, with respect to the total weight of elements present on the surface of the toner particle, from a viewpoint of laminating properties of an image to be obtained.

In the exemplary embodiment, a measuring method of the amount of the white pigment on the surface of the toner particle is as follows.

The toner particles are dispersed in liquid, external additives of the toner particles are removed using ultrasonic treatment, drying is performed again, and toner base particles are taken out. At this time, in a case of using a dispersing agent in the dispersion in the liquid, washing of the dispersing agent is performed to perform a collection operation of the toner base particles. Regarding the surface of the obtained toner base particle, a proportion of weight of an element which is the white pigment on the surface of the toner particles is calculated using an X-ray photoemission spectrometer. Regarding the white pigment obtained by an extraction method of the white pigment which will be described later, element information is obtained using an X-ray fluorescence spectrometer. Among the proportions of weight of elements on the surface of the toner particle, % by weight of the element derived from the pigment is set as the amount of the white pigment on the surface of the toner particle. The element information of the white pigment may be determined depending on the result of the fluorescent X-ray analysis of the white pigment obtained by an extraction method of a white pigment.

In the electrostatic charge image developing toner according to this exemplary embodiment, a value of a refractive index $R^w$ of the white pigment is preferably 2.00 to 2.90, more preferably 2.20 to 2.90, and particularly preferably 2.40 to 2.90, from a viewpoint of concealing properties of an image to be obtained.

In this exemplary embodiment, a measuring method of the refractive index of the white pigment is as follows.

The external additive of the toner particles are removed using ultrasonic treatment, the obtained toner base particles are dissolved using a solvent that may dissolve a binder resin of the toner base particles, such as acetone or methyl ethyl ketone, and the white pigment at high density is separated using a centrifugal separator. The refractive index of the white pigment obtained is measured using a measuring method disclosed in JIS K 7142, for example.

The volume average particle diameter (D50v) of the toner particles is preferably 2 μm to 10 μm and more preferably 4 μm to 8 μm.

Various average particle diameters and various particle size distribution indices of the toner particles are measured by using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume particle size distribution index (GSDv) is calculated as $(D84v/D16v)^{1/2}$, while a number particle size distribution index (GSDp) is calculated as $(D84p/D16p)^{1/2}$.

The electrostatic charge image developing toner according to the exemplary embodiment includes toner particles, and if necessary, an external additive.

Toner Particles

The toner particles include a binder resin, a white pigment, and if necessary, a release agent and other additives.

White Pigment

Specific examples of the white pigment include inorganic pigments (for example, heavy calcium carbonate, light calcium carbonate, titanium dioxide, aluminum hydroxide, satin white, talc, calcium sulfate, barium sulfate, zinc oxide, magnesium oxide, magnesium carbonate, amorphous silica, colloidal silica, white carbon, kaolin, calcined kaolin, delaminated kaolin, aluminosilicate, sericite, bentonite, and smectite), and organic pigments (for example, polystyrene resin particles and urea-formalin resin particles).

Among these, titanium dioxide is preferably used.

The white pigment may be used singly or in combination of two or more kinds thereof.

As the white pigment, the surface-treated white pigment may be used, if necessary, and may be used in combination with a dispersing agent.

The volume average particle diameter of the white pigment is preferably 100 nm to 1,000 nm, more preferably 100 nm to 500 nm, and even more preferably 120 nm to 380 nm, from viewpoints of concealing properties and whiteness of an image to be obtained.

Regarding the volume average particle diameter of the white pigment, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v.

The content of the white pigment is preferably 20% by weight to 60% by weight, more preferably 25% by weight to 55% by weight, and particularly preferably 30% by weight to 50% by weight, with respect to the total content of the toner particles, from viewpoints of concealing properties and whiteness of an image to be obtained and granulation properties of the toner particles.

Binder Resin

Examples of the binder resin include vinyl resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, laurylmethacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used singly or in combination of two or more kinds thereof.

As the binder resin, a polyester resin is appropriate.

As the polyester resin, for example, a well-known amorphous polyester resin is included. As the polyester resin, a crystalline polyester resin may be used together with the amorphous polyester resin. Here, the content of the crystalline polyester resin may be in a range of 2% by weight to 40% by weight (preferably, 2% by weight to 20% by weight) with respect to the total content of the binder resin.

The "crystallinity" of the resin does not indicate a stepwise change in endothermic energy amount, but indicates a clear endothermic peak, in differential scanning calorimetry (DSC), and specifically, indicates that a half-value width of an endothermic peak is within 10° C., when it is measured at a rate of temperature rise of 10 (° C./min).

Meanwhile, the "non-crystallinity" of the resin indicates that a half-value width exceeds 10° C., a stepwise change in endothermic energy amount is shown, or a clear endothermic peak is not confirmed.

Amorphous Polyester Resin

Examples of the amorphous polyester resin include condensation polymers of polyvalent carboxylic acids and polyols. A commercially available product or a synthesized product may be used as the amorphous polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these substances, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the amorphous polyester resin is preferably from 50° C. to 80° C., and more preferably from 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K 7121-1987.

The weight average molecular weight (Mw) of the amorphous polyester resin is preferably 5,000 to 1,000,000 and more preferably 7,000 to 500,000.

The number average molecular weight (Mn) of the amorphous polyester resin is preferably 2,000 to 100,000.

The molecular weight distribution Mw/Mn of the amorphous polyester resin is preferably 1.5 to 100 and more preferably 2 to 60.

The weight average molecular weight and the number average molecular weight are measured by gel permeation chromatography (GPC). The molecular weight measurement by GPC is performed by using GPC.HLC-8120 GPC manufactured by Tosoh Corporation as a measuring device, TSKGEL SUPERHM-M (15 cm) manufactured by Tosoh Corporation, as a column, and a THF solvent. The weight average molecular weight and the number average molecular weight are calculated using a calibration curve of molecular weight obtained with a monodisperse polystyrene standard sample from the measurement results obtained from the measurement.

A well-known preparing method is applied to prepare the amorphous polyester resin. Specific examples thereof include a method of conducting a reaction at a polymerization temperature set to 180° C. to 230° C., if necessary, under reduced pressure in the reaction system, while removing water or an alcohol generated during condensation.

In the case in which monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In the case in which a monomer having poor compatibility is present, the monomer having poor compatibility and an acid or an alcohol to be polycondensed with the monomer may be previously condensed and then polycondensed with the main component.

Crystalline Polyester Resin

Examples of the crystalline polyester resin include condensation polymers of polyvalent carboxylic acids and polyols. A commercially available product or a synthesized product may be used as the crystalline polyester resin.

Here, as the crystalline polyester resin, a condensation polymer obtained using a polymerizable monomer including a linear aliphatic group is preferable than that obtained using a polymerizable monomer including an aromatic group, in order to easily form a crystalline structure.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetra decane dicarboxylic acid, and 1,18-octadecane dicarboxylic acid), aromatic dicarboxylic acids (e.g., phthalic acid, isophthalic acid, terephthalic acid, dibasic acid of naphthalene-2,6-dicarboxylic acid), anhydrides thereof, or lower alkyl esters (having, for example, from 1 to 5 carbon atoms) thereof.

As the polyvalent carboxylic acid, a tri- or higher-valent carboxylic acid employing a crosslinked structure or a branched structure may be used in combination with a dicarboxylic acid. Examples of the trivalent carboxylic acid include aromatic carboxylic acid (e.g., 1,2,3-benzenetricarboxylic acid, 1,2,4-benzenetricarboxylic acid, and 1,2,4-naphthalene tricarboxylic acid), anhydrides thereof, or lower alkyl esters (having, for example, from 1 to 5 carbon atoms) thereof.

As the polyvalent carboxylic acid, a dicarboxylic acid having a sulfonic acid group and a dicarboxylic acid having an ethylenic double bond may be used in combination with the dicarboxylic acids described above.

The polyvalent carboxylic acids may be used singly or in combination of two or more kinds thereof.

Examples of the polyol include aliphatic diols (e.g., linear aliphatic diol having 7 to 20 carbon atoms of main chain part). Examples of aliphatic diols include ethylene glycol, 1,3-propanediol, 1,4-butanediol, 1,5-pentanediol, 1,6-hexanediol, 1,7-heptane diol, 1,8-octanediol, 1,9-nonanediol, 1,10-decanediol, 1,11-undecanediol, 1,12-dodecane diol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferable as aliphatic diols.

As the polyol, a tri- or higher-valent alcohol employing a crosslinked structure or a branched structure may be used in combination with a diol. Examples of the tri- or higher-valent polyol include glycerin, trimethylolethane, trimethylolpropane, and pentaerythritol.

The polyols may be used singly or in combination of two or more kinds thereof.

Here, in the polyol, the content of aliphatic diol may be equal to or greater than 80 mol % and is preferably 90 mol % or more.

A melting temperature of the crystalline polyester resin is preferably 50° C. to 100° C., more preferably 55° C. to 90° C., and even more preferably 60° C. to 85° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

A weight average molecular weight (Mw) of the crystalline polyester resin is preferably 6,000 to 35,000.

The crystalline polyester resin is obtained by using a well-known manufacturing method, in the same manner as the amorphous polyester resin, for example.

The content of the binder resin is, for example, preferably 40% by weight to 95% by weight, more preferably 50% by weight to 90% by weight, and even more preferably 60% by weight to 85% by weight with respect to a total amount of toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably 50° C. to 110° C. and more preferably 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

The content of the release agent is, for example, preferably 1% by weight to 20% by weight, and more preferably 5% by weight to 15% by weight with respect to the total amount of the toner particles.

Other Additives

Examples of other additives include well-known additives such as a magnetic material, a charge-controlling agent, and an inorganic particle. The toner particles include these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, the toner particles having a core/shell structure may be configured with, for example, a core including a binder resin, and if necessary, other additives such as a colorant and a release agent, and a coating layer including a binder resin.

An average circularity of the toner particles is preferably 0.94 to 1.00 and more preferably 0.95 to 0.98.

The average circularity of the toner particles is determined by an expression of (perimeter of equivalent circle diameter)/(perimeter) [(perimeter of a circle having the same projected area as that of a particle image)/(perimeter of particle projection image)]. Specifically, the average circularity thereof is a value measured using the following method.

First, the toner particles which is a measurement target are sucked and collected, a flat flow is formed, stroboscopic light emission is instantly performed to obtain a particle image as a still image, and the average circularity is determined using a flow-type particle image analysis device (FPIA-2100 manufactured by Sysmex Corporation) which performs image analysis of the particle image. 3,500 particles are sampled when determining the average circularity.

In a case where the toner includes an external additive, the toner (developer) which is a measurement target is dispersed in water including a surfactant, and then, the ultrasonic treatment is performed to obtain toner particles from which the external additive is removed.

External Additive

As the external additives, inorganic particles are used, for example. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles as the external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, 1 part by weight to 10 parts by weight with respect to 100 parts by weight of the inorganic particles.

Examples of the external additives also include resin particles (resin particles such as polystyrene, polymethyl methacrylate (PMMA), and melamine resin) and a cleaning aid (for example, a metal salt of higher fatty acid represented by zinc stearate, and fluorine polymer particles).

The amount of the external additives externally added is, for example, preferably 0.01% by weight to 5% by weight, and more preferably 0.01% by weight to 2.0% by weight with respect to the amount of the toner particles.

Manufacturing Method of Electrostatic Charge Image Developing Toner

Next, a manufacturing method of the electrostatic charge image developing toner according to this exemplary embodiment will be described.

The toner according to the exemplary embodiment is obtained by externally adding an external additive to toner particles, if necessary, after preparing the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles may be obtained by the aggregation and coalescence method.

Particularly, from a viewpoint of obtaining toner particles in which the maximum frequent value and the skewness in distribution of the eccentricity satisfy the ranges described above, it is preferable that the toner particles are prepared by an aggregation and coalescence method described below.

Next, an aggregation and coalescence method is described below.

Specifically, the toner particle is preferably prepared by processes as follows: a process of preparing each dispersion (dispersion preparation process); a process (first aggregated particle forming process); a process (second aggregated particle forming process); and a process (coalescence process) In the first aggregated particle forming process, particles are aggregated in a dispersion obtained by mixing a first resin particle dispersion and a release agent particle dispersion, and thereby first aggregated particles are formed. The first resin particle dispersion is obtained by dispersing first resin particles corresponding to the binder resin, and the release agent particle dispersion is obtained by dispersing particles of the release agent (also referred to as "release agent particles" below). In the second aggregated particle forming process, a dispersion mixture in which second resin particles corresponding to the binder resin and particles of the white pigment (also referred to as "white pigment" below) are dispersed is prepared. After a first aggregated particle dispersion in which the first aggregated particles are dispersed is prepared, the dispersion mixture is sequentially added to the first aggregated particle dispersion while the concentration of the white pigment in the dispersion mixture slowly increases. Thus, the second resin particles and the white pigment are aggregated on a surface of the first aggregated particles, and thereby second aggregated particles are formed. In the coalescence process, a second aggregated particle dispersion in which the second aggregated particles are dispersed is heated to coalesce the second aggregated particles, and thereby toner particles are formed.

The method of preparing the toner particle is not limited to the above descriptions. For example, particles are aggregated in a dispersion mixture obtained by mixing the resin particle dispersion and the release agent particle dispersion. Then, a white pigment agent particle dispersion is added to the dispersion mixture in the process of aggregation while increasing an addition speed slowly or while increasing the concentration of the white pigment increases. Thus, aggregation of particles proceeds more, and thereby aggregated particles are formed. The toner particles may be formed by coalescing the aggregated particles.

The processes will be described below in detail.

Preparation Process of Dispersion

First, respective dispersions are prepared by using an aggregation and coalescence method. Specifically, a first resin particle dispersion in which first resin particles corresponding to the binder resin are dispersed, a release agent particle dispersion in which release agent particles are dispersed, a second resin particle dispersion in which second resin particles corresponding to the binder resin are dispersed, and a white pigment particle dispersion in which the white pigment is dispersed are prepared.

In the dispersion preparation process, descriptions will be made, referring the first resin particles and the second resin particles to as "resin particles" collectively.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the white pigment particle dispersion and the release agent particle dispersion are also prepared in the same manner as in the case of the resin particle dispersion. That is, the white pigment dispersed in the white pigment dispersion and the release agent particles dispersed in the release agent particle dispersion are the same as the particles in the resin particle dispersion, in terms of the volume average particle diameter, the dispersion medium, the dispersing method, and the content of the particles.

First Aggregated Particle Forming Process

Next, the first resin particle dispersion and the release agent dispersion are mixed together.

The first resin particles and the release agent particles are heterogeneously aggregated in the dispersion mixture, and thereby first aggregated particles including first resin particles and release agent particles are formed.

Specifically, for example, an aggregating agent is added to the dispersion mixture and a pH of the dispersion mixture is adjusted to be acidic (for example, the pH is from 2 to 5). If necessary, a dispersion stabilizer is added. Then, the dispersion mixture is heated at the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the dispersion mixture, and thereby the first aggregated particles are formed.

In the first aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the first resin particles.

Second Aggregated Particle Forming Process

Next, after the first aggregated particle dispersion in which the first aggregated particles are dispersed is obtained, a dispersion mixture in which the second resin particles and the white pigment are dispersed is sequentially added to the first aggregated particle dispersion while increasing the concentration of the white pigment in the dispersion mixture slowly.

The second resin particles may be the same type as or a different type or from the first resin particles.

Furthermore, the dispersion mixture may further contain a release agent particle.

The second resin particles and the white pigment are aggregated on surfaces of the first aggregated particles in a dispersion in which the first aggregated particles, the second resin particles, and the white pigment are dispersed. Specifically, for example, in the first aggregated particle forming process, when a particle diameter of the first aggregated particle reaches a desired particle diameter, a dispersion mixture in which the second resin particles and the white pigment are dispersed is added to the first aggregated particle dispersion while increasing the concentration of the white pigment slowly. The dispersion is heated at a temperature which is equal to or less than the glass transition temperature of the second resin particles.

For example, the pH of the dispersion is substantially in a range of from 6.5 to 8.5, and thus the progress of the aggregation is stopped.

Aggregated particles in which the second resin particles and the white pigment are attached to the surfaces of the first aggregated particles are formed through this process. That is, second aggregated particles in which aggregates of the second resin particles and the white pigment are attached to the surfaces of the first aggregated particles are formed. At this time, since the dispersion mixture in which the second resin particles and the white pigment are dispersed is sequentially added to the first aggregated particle dispersion while increasing the concentration of the white pigment in the dispersion mixture slowly, the concentration (abundance ratio) of the white pigment becomes slowly larger toward the radially outside direction of the particles, and thus, the aggregates of the second resin particles and the white pigment are attached to the surface of the first aggregated particle.

As a method of adding the dispersion mixture, a power feeding addition method may preferably be used. The dispersion mixture may be added to the first aggregated particle dispersion, with a gradual increase of the concentration of the white pigment in the dispersion mixture, by using the power feeding addition method.

The method of adding the dispersion mixture using the power feeding addition method will be described with reference to the drawing.

Figure 3:
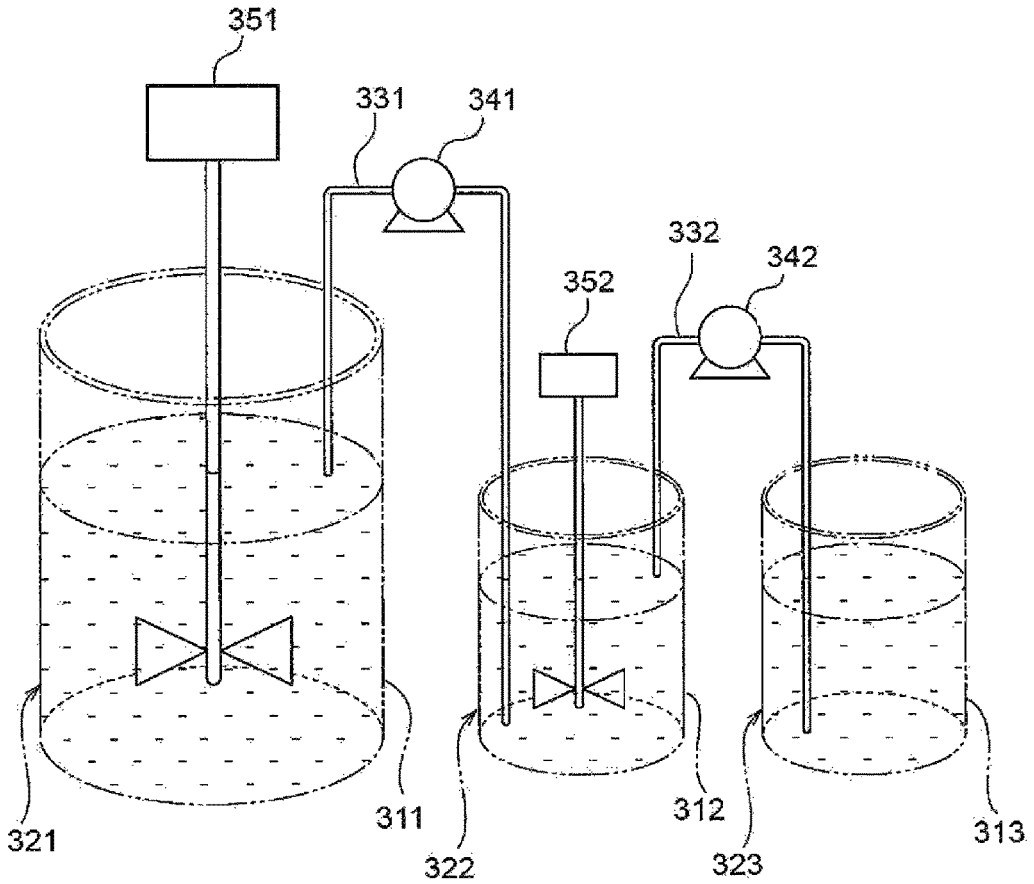
FIG. 3 is a schematic view for explaining a power feeding addition method.

FIG. 3 illustrates an apparatus used in the power feeding addition method. In FIG. 3, the reference numeral 311 indicates the first aggregated particle dispersion, the reference numeral 312 indicates the second resin particle dispersion, the reference numeral 313 indicates the white pigment dispersion.

The apparatus illustrated in FIG. 3 includes a first storage tank 321, a second storage tank 322, and a third storage tank 323. In the first storage tank 321, the first aggregated particle dispersion in which the first aggregated particles are dispersed is stored. In the second storage tank 322, the second resin particle dispersion in which the second resin particles are dispersed is stored. In the third storage tank 323, the white pigment dispersion in which the white pigment are dispersed is stored.

The first storage tank 321 and the second storage tank 322 are linked to each other by using a first liquid transport tube 331. A first liquid transport pump 341 is provided in the middle of a path of the first liquid transport tube 331. Driving of the first liquid transport pump 341 causes the dispersion stored in the second storage tank 322 to be transported to the dispersion stored in the first storage tank 321 through the first liquid transport tube 331.

A first stirring apparatus 351 is disposed in the first storage tank 321. When driving of the first stirring apparatus 351 causes the dispersion stored in the second storage tank 322 to be transported to the dispersion stored in the first storage tank 321, the dispersions in the first storage tank 321 are stirred and mixed.

The second storage tank 322 and the third storage tank 323 are linked to each other by using a second liquid transport tube 332. A second liquid transport pump 342 is provided in the middle of a path of the second liquid transport tube 332. Driving of the second liquid transport pump 342 causes the dispersion stored in the third storage tank 323 to be transported to the dispersion stored in the second storage tank 322 through the second liquid transport tube 332.

A second stirring apparatus 352 is disposed in the second storage tank 322. When driving of the second stirring apparatus 352 causes the dispersion stored in the third storage tank 323 to be transported to the dispersion stored in the second storage tank 322, the dispersions in the second storage tank 322 are stirred and mixed.

In the apparatus illustrated in FIG. 3, first, the first aggregated particle forming process is performed and thereby a first aggregated particle dispersion is prepared, in the first storage tank 321. The first aggregated particle dispersion is stored in the first storage tank 321. The first aggregated particle forming process may be performed and thereby the first aggregated particle dispersion may be prepared in another tank, and then, the first aggregated particle dispersion may be stored in the first storage tank 321.

In this state, the first liquid transport pump 341 and the second liquid transport pump 342 are driven. This driving causes the second resin particle dispersion stored in the second storage tank 322 to be transported to the first aggregated particle dispersion stored in the first storage tank 321. Driving of the first stirring apparatus 351 causes the dispersions in the first storage tank 321 to be stirred and mixed.

The white pigment dispersion stored in the third storage tank 323 is transported to the second resin particle dispersion stored in the second storage tank 322. Driving of the second stirring apparatus 352 causes the dispersions in the second storage tank 322 to be stirred and mixed.

At this time, the white pigment dispersion is sequentially transported to the second resin particle dispersion stored in the second storage tank 322, and thus the concentration of the white pigment becomes higher slowly. For this reason, the dispersion mixture in which second resin particles and the white pigment are dispersed is stored in the second storage tank 322, and this dispersion mixture is transported to the first aggregated particle dispersion stored in the first storage tank 321. The dispersion mixture is continuously transported with an increase of the concentration of the white pigment dispersion in the dispersion mixture.

In this manner, the dispersion mixture in which the second resin particles and the white pigment are dispersed may be added to the first aggregated particle dispersion with a gradual increase of the concentration of the white pigment, by using the power feeding addition method.

In the power feeding addition method, a degree of eccentricity of the white pigment of the toner particles are adjusted by adjusting liquid transport starting time and a liquid transport speed for each of the dispersions which are respectively stored in the second storage tank 322 and the third storage tank 323. In the power feeding addition method, also by adjusting the liquid transport speed in the process of transporting of the dispersions respectively stored in the second storage tank 322 and the third storage tank 323, a degree of eccentricity of the white pigment of the toner particles is adjusted.

The above-described power feeding addition method is not limited to the above method. For example, 1) various methods may be employed. Examples of the various methods include a method in which, a storage tank storing the second resin particle dispersion and a storage tank storing a dispersion mixture in which the second resin particles and the white pigment are dispersed are separately provided and the respective dispersions are transported to the first storage tank 321 from the respective storage tanks while changing the liquid transport speed, a method in which a storage tank storing the white pigment dispersion and a storage tank storing a dispersion mixture in which the second resin particles and the white pigment are dispersed are separately provided, and the respective dispersions are transported to the first storage tank 321 from the respective storage tanks while changing the liquid transport speed, and the like.

As described above, the second aggregated particles in which the second resin particles and the white pigment are attached to the surfaces of the first aggregated particles and aggregated are obtained.

Coalescence Process

Next, the second aggregated particle dispersion in which the second aggregated particles are dispersed is heated at, for example, a temperature that is equal to or higher than the glass transition temperature of the first and second resin particles (for example, a temperature that is higher than the glass transition temperature of the first and second resin particles by 10° C. to 30° C.) to coalesce the second aggregated particles.

When toner particles are prepared as described above, an abundance ratio of the white pigment in the vicinity of the surface is increased.

After the second aggregated particle dispersion in which the second aggregated particles are dispersed is obtained, toner particles may be prepared through the processes of: further mixing the second aggregated particle dispersion with the third resin particle dispersion in which third resin particles which is a binder resin are dispersed to conduct aggregation so that the third resin particles further adhere to the surfaces of the second aggregated particle dispersion, thereby forming third aggregated particles; and coalescing the second aggregated particles by heating the third aggregated particle dispersion in which the third aggregated particles are dispersed, thereby forming toner particles having a core/shell structure.

As described above, when a shell layer formed of a binder resin (or having a small content of the white pigment, even when the white pigment is included) is further formed on the surface of the second aggregated particles, the proportion of the white pigment exposed to the surface of the toner particles is decreased.

When the toner particles are prepared as described above, the ranges of the maximum frequent value and the skewness in the distribution of the eccentricity of the white pigment in the toner particles are easily satisfied.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, and suction filtration, pressure filtration, or the like may be performed from the viewpoint of productivity. The method for the drying process is also not particularly limited, and freeze drying, flush drying, fluidized drying, vibration-type fluidized drying, or the like may be performed from a viewpoint of productivity.

Then, the toner according to this exemplary embodiment may be prepared by adding an external additive to the obtained dry toner particles and mixing the materials. The mixing may be performed by using a V blender, a HENSCHEL MIXER, a LÖDIGE mixer, and the like. Further, if necessary, coarse toner particles may be removed by using a vibration classifier, a wind classifier, and the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment or may be a two-component developer obtained by mixing the toner and a carrier.

The carrier is not particularly limited and known carriers are exemplified. Examples of the carrier include a coating carrier in which surfaces of cores formed of magnetic particles are coated with a coating resin; a magnetic particle dispersion-type carrier in which magnetic particles are dispersed and blended in a matrix resin; and a resin impregnation-type carrier in which a porous magnetic particle is impregnated with a resin.

The magnetic particle dispersion-type carrier and the resin impregnation-type carrier may be carriers in which constituent particles of the carrier are cores and coated with a coating resin.

Examples of the magnetic particle include particles of magnetic metals such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably 1:100 to 30:100, and more preferably 3:100 to 20:100 (toner: carrier).

Image Forming Apparatus and Image Forming Method

An image forming apparatus and an image forming method according to this exemplary embodiment will be described.

An image forming apparatus according to this exemplary embodiment includes an image holding member, a charging unit that charges a surface of the image holding member, an electrostatic charge image forming unit that forms an electrostatic charge image on the charged surface of the image holding member, a developing unit that contains an electrostatic charge image developer and develops the electrostatic charge image formed on the surface of the image holding member with the electrostatic charge image developer as a toner image, a transfer unit that transfers the toner image formed on the surface of the image holding member to a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including the processes of: charging a surface of an image holding member; forming an electrostatic charge image on the charged surface of the image holding member; developing the electrostatic charge image formed on the surface of the image holding member with the electrostatic charge image developer according to this exemplary embodiment as a toner image; transferring the toner image formed on the surface of the image holding member to a surface of a recording medium; and fixing the toner image transferred onto the surface of the recording medium is performed.

As the image forming apparatus according to this exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; an apparatus that is provided with a cleaning unit that cleans a surface of an image holding member before charging after transfer of a toner image; or an apparatus that is provided with an erasing unit that irradiates, after transfer of a toner image, a surface of an image holding member with erase light before charging for erasing.

In the case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that includes a container that contains the electrostatic charge image developer according to this exemplary embodiment and is provided with a developing unit is suitably used.

Hereinafter, an example of the image forming apparatus according to this exemplary embodiment will be shown. However, the image forming apparatus is not limited thereto. Main portions shown in the drawing will be described, but descriptions of other portions will be omitted.

FIG. 1 is a schematic configuration diagram showing the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a support roll 24 contacting the inner surface of the intermediate transfer belt 20 and a driving roll 22, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by irradiating the photosensitive layer with laser beams 3Y so that the specific resistance of the irradiated part is lowered to cause charges to flow on the surface of the photoreceptor 1Y, while charges stay on a part which is not irradiated with the laser beams 3Y.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge Set

A process cartridge according to this exemplary embodiment will be described.

The process cartridge according to this exemplary embodiment is provided with a developing unit that includes a container that contains the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
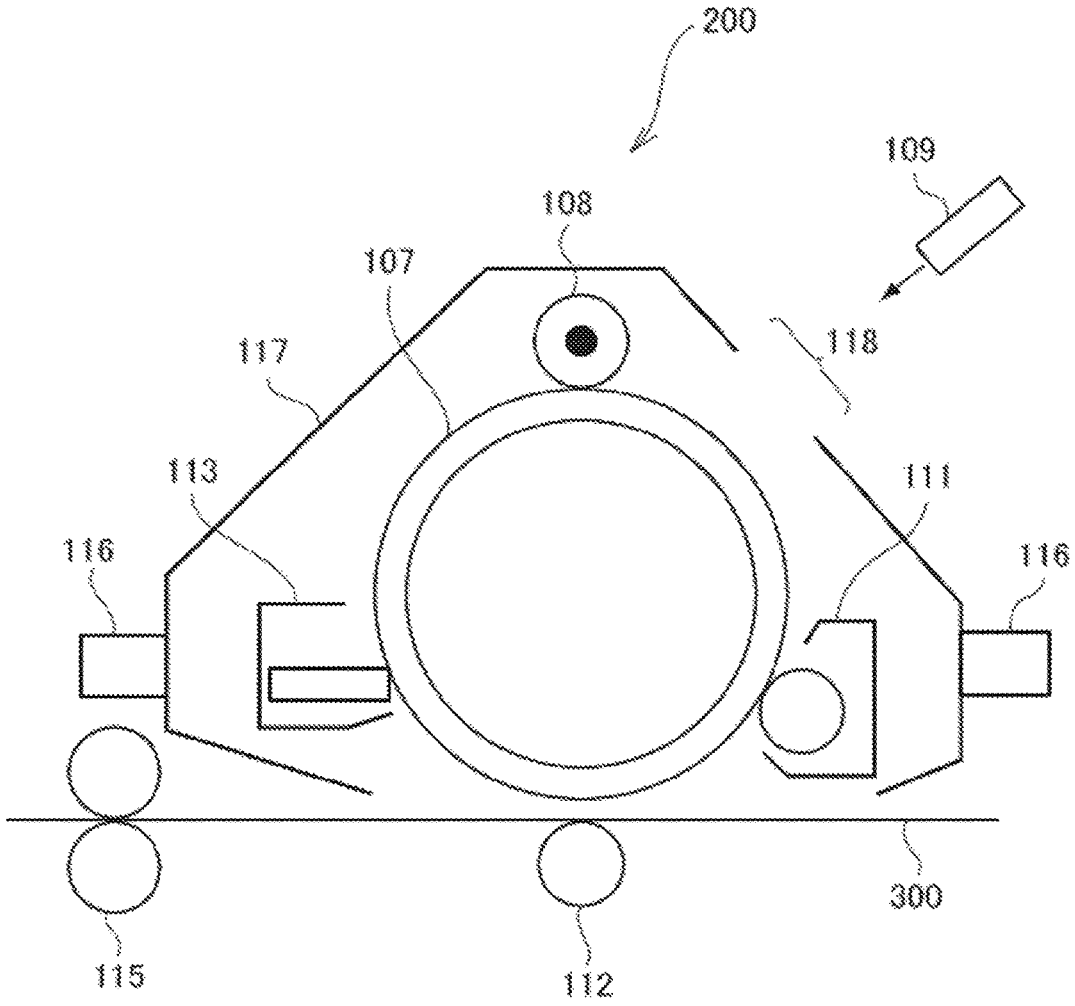
FIG. 2 is a schematic configuration diagram showing an example of a process cartridge according to this exemplary embodiment.

FIG. 2 is a schematic configuration diagram showing the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment includes a container that contains the toner according to this exemplary embodiment and is detachable from an image forming apparatus. The toner cartridge includes a container that contains a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

Hereinafter, the exemplary embodiment of the invention will be described in detail using examples and comparative examples, but the exemplary embodiment of the invention is not limited to the examples below. In the following descriptions, "parts" are based on weight, unless specifically noted.

Preparation of Crystalline Polyester Resin (Particle Dispersion Thereof)

Synthesis of Crystalline Polyester Resin 266 parts of 1,12-dodecanedicarboxylic acid, 169 parts of 1,10-decanediol, 0.035 parts of tetrabutoxy titanate as a catalyst are added in a heated and dried three-necked flask, air in the vessel is turned into an inert atmosphere with nitrogen gas by performing pressure reducing operation, and the mixture is stirred by mechanical stirring at 180° C. for 6 hours. After that, the temperature is slowly increased to 220° C. by distillation under reduced pressure, stirring is performed for 2.5 hours, and a resin acid value is measured when the mixture is in a viscous state. When a resin acid value is 15.0 mgKOH/g, the distillation under reduced pressure is stopped, followed by air cooling, and thus, a crystalline polyester resin is obtained.

When a weight average molecular weight (Mw) of the obtained crystalline polyester resin is measured by the method described above, the weight average molecular weight thereof is 13,000. When a melting temperature of the obtained crystalline polyester resin is measured with differential scanning calorimetry (DSC), the melting temperature thereof is 73° C.

Next, 180 parts of the obtained crystalline polyester resin and 585 parts of deionized water are put into a stainless steel beaker, and the beaker is put in a warm bath, and heated to 95° C. When the crystalline polyester resin is melted, the mixture is stirred at 8,000 rpm using a homogenizer (ULTRA TURRAX T50 manufactured by IKA Works, Inc.), diluted ammonia aqueous solution is added at the same time, and the pH is adjusted to 7.0. The emulsion dispersion is performed while adding 0.8 parts of an anionic surfactant (NEOGEN R manufactured by DKS Co., Ltd.) dropwise in 20 parts of a diluted aqueous solution, and thus, a crystalline polyester resin particle dispersion (resin particle concentration: 40% by weight) having a volume average particle diameter of 0.23 μm is prepared.

Preparation of Amorphous Polyester Resin (Particle Dispersion Thereof)

74 parts of dimethyl adipate, 192 parts of dimethyl terephthalate, 216 parts of bisphenol A ethylene oxide adduct, 38 parts of ethylene glycol, and 0.037 parts of tetrabutoxy titanate as a catalyst are put in a heated and dried two-necked flask, the temperature is increased while nitrogen gas is introduced into the vessel to maintain the air in an inert atmosphere, and co-polycondensation is performed at 160° C. for approximately 7 hours. After that, the temperature is increased to 220° C. while slowly reducing pressure to 10 Torr, and the mixture is kept for 4 hours. The pressure is temporarily returned to normal pressure (atmospheric pressure, the same applies hereinafter), 9 parts of trimellitic anhydride is added, the pressure is slowly reduced again to 10 Torr, the mixture is kept for 1 hour, and thus, an amorphous polyester resin is synthesized. 1 Torr is (101,325/760) Pa.

When a glass transition temperature of the obtained amorphous polyester resin is measured with differential scanning calorimetry (DSC) by the measuring method described above, the glass transition temperature thereof is 60° C. When a molecular weight of the obtained amorphous polyester resin is measured with GPC by the measuring method described above, the weight average molecular weight (Mw) thereof is 12,000. When an acid value of the obtained amorphous polyester resin is measured, the acid value thereof is 25.0 mgKOH/g.

115 parts of the obtained amorphous polyester resin, 180 parts of deionized water, and 5 parts of an anionic surfactant (NEOGEN R manufactured by DKS Co., Ltd.) are mixed with each other, heated to 120° C., and sufficiently dispersed with a homogenizer (ULTRA TURRAX T50 manufactured by IKA Works, Inc.), a dispersion process is performed using a PRESSURE DISCHARGE TYPE GAULIN HOMOGENIZER for 1 hour, and thus, an amorphous polyester resin particle dispersion (concentration of resin particles: 40% by weight) is prepared.

Preparation of White Pigment Dispersion 1

White pigment 1 (titanium oxide, A-220 manufactured by Ishihara Sangyo Kaisha, Ltd., average primary particle diameter of 0.16 μm): 100 parts Anionic surfactant (NEOGEN R manufactured by DKS Co., Ltd.): 15 parts Ion exchange water: 400 parts The above components are mixed with each other, dissolved, and dispersed by using a high pressure impact type dispersing machine ULTIMIZER (HJP30006 manufactured by SUGINO MACHINE LIMITED) for about 3 hours, and thus, a white colorant dispersion 1 is prepared.

When a volume average particle diameter of the colorant (titanium oxide) of the obtained white pigment dispersion 1 is measured using a laser diffraction-type particle size distribution measuring device, the volume average particle diameter thereof is 0.240 μm. A solid content ratio of the white pigment dispersion 1 is 23% by weight.

Preparation of White Pigment Dispersion 2

A white pigment dispersion 2 is obtained by the same method described above, except for changing the white pigment 1 to a white pigment 2 (titanium oxide, JR-301 manufactured by Tayca Corporation, average primary particle diameter of 0.30 μm).

When a volume average particle diameter of the colorant (titanium oxide) of the obtained white pigment dispersion 2 is measured using a laser diffraction-type particle size distribution measuring device, the volume average particle diameter thereof is 0.330 μm.

Preparation of Release Agent Particle Dispersion 90 parts of Fischer Tropsch Wax HNP 9 (melting temperature of 72° C.: manufactured by Nippon Seiro Co., Ltd.), 3.6 parts of an anionic surfactant (NEOGEN R manufactured by DKS Co., Ltd.), and 360 parts of ion exchange water are mixed with each other, heated to 100° C., and sufficiently dispersed with a homogenizer (ULTRA TURRAX T50 manufactured by IKA Works, Inc.), a dispersion process is performed using a PRESSURE DISCHARGE TYPE GAULIN HOMOGENIZER, and thus, a release agent particle dispersion is obtained. When a volume average particle diameter of the release agent particles in the obtained release agent particle dispersion is measured using a laser diffraction-type particle size distribution measuring device, the volume average particle diameter thereof is 0.23 μm. A solid content ratio of the release agent particle dispersion is 20% by weight.

Example 1

Preparation of Toner Particles

An apparatus (see FIG. 3) in which a round stainless steel flask and a vessel A are connected to each other through a tube pump A, a solution contained in the vessel A is transmitted to the flask by the driving of the tube pump A, the vessel A and a vessel B are connected to each other through a tube pump B, and a solution contained in the vessel B is transmitted to the vessel A by the driving of the tube pump B is prepared. The following operations are performed using this apparatus.

Crystalline polyester resin dispersion: 49.4 parts

Amorphous polyester resin dispersion: 450.6 parts

Release agent particle dispersion: 40 parts

Anionic surfactant (TaycaPower manufactured by Tayca Corporation): 2 parts

The above materials are put into the round stainless steel flask, 0.1 N of nitric acid is added thereto to adjust the pH to 3.5, and then, 30 parts of a nitric acid aqueous solution having polyaluminum chloride concentration of 10% by weight is added thereto. Then, the resultant material is dispersed at 30° C. with a homogenizer (ULTRA TURRAX T50 manufactured by IKA Works, Inc.), and a temperature is increased at a rate of 1° C./30 min in a heating oil bath to thereby increase a particle diameter of aggregated particles.

Meanwhile, 150 parts of the amorphous polyester resin dispersion and 15 parts of white pigment dispersion 1 are put into the vessel A of a polyester bottle and 40 parts of the white pigment dispersion 1 is put into the vessel B in the same manner. Then, a solution transmission rate of the tube pump A is set as 0.68 part/1 min, a solution transmission rate of the tube pump B is set as 0.13 part/1 min, the tube pump A and the tube pump B are driven when a temperature in the round stainless steel flask during the formation of aggregating particles has reached 37° C., and transmission of each dispersion is started. Accordingly, a mixed dispersion in which the resin particles and the white pigment particles are dispersed is transmitted to the round stainless steel flask in which the aggregated particles are being formed from the vessel A, while slowly increasing concentration of the white pigment particles.

The resultant material is maintained for 30 minutes after the transmission of each dispersion to the flask is completed and the temperature in the flask becomes 48° C., and thus, the second aggregated particles are formed.

Then, 50 parts of the amorphous polyester resin dispersion is gently added and maintained for 1 hour, 0.1 N sodium hydroxide aqueous solution is added thereto to adjust pH to 8.5, the mixture is heated to 85° C. while stirring, and maintained for 5 hours. After that, the temperature is decreased to 20° C. at a rate of 20° C./min, the resultant material is filtered, sufficiently washed with ion exchange water, and dried, to thereby obtain toner particles (1) having a volume average particle diameter of 6.0 μm.

Preparation of Toner 100 parts of the toner particles (1) and 0.7 parts of dimethylsilicone oil-treated silica particles (RY200 Nippon Aerosil co., Ltd.) are mixed with each other with a HENSCHEL MIXER, and thus, a toner 1 is obtained.

Preparation of Developer

Ferrite particles (average particle diameter of 50 μm): 100 parts

Toluene: 14 parts

A styrene-methyl methacrylate copolymer (copolymerization ratio: 15/85 (weight ratio)): 3 parts Carbon black: 0.2 parts The above components except for the ferrite particles are dispersed by a sand mill to prepare dispersion, this dispersion and the ferrite particles are put into a vacuum degassing type kneader, dried while stirring under the reduced pressure, and thus, a carrier is obtained.

8 parts of the toner 1 is mixed with 100 parts of the carrier, and thus, a developer 1 is obtained.

Example 2

Toner particles (2) are obtained in the same manner as in the preparation of the toner particles (1) in Example 1, except for driving the tube pumps A and B when a temperature in the round stainless steel flask during the formation of aggregating particles has reached 34° C.

A volume average particle diameter of the obtained toner particles (2) is 5.9 μm. A toner 2 and a developer 2 are obtained in the same manner as in Example 1 except for using the toner particles (2).

Example 3

Toner particles (3) are obtained in the same manner as in the preparation of the toner particles (1) in Example 1, except for driving the tube pumps A and B when a temperature in the round stainless steel flask during the formation of aggregating particles has reached 40° C.

A volume average particle diameter of the obtained toner particles (3) is 6.1 μm. A toner 3 and a developer 3 are obtained in the same manner as in Example 1 except for using the toner particles (3).

Example 4

Toner particles (4) are obtained in the same manner as in the preparation of the toner particles (1) in Example 1, except for changing the solution transmission rate of the tube pump A to 0.55 part/1 min and the solution transmission rate of the tube pump B to 0.15 part/1 min.

A volume average particle diameter of the obtained toner particles (4) is 5.8 μm. A toner 4 and a developer 4 are obtained in the same manner as in Example 1 except for using the toner particles (4).

Example 5

Toner particles (5) are obtained in the same manner as in the preparation of the toner particles (1) in Example 1, except for changing the solution transmission rate of the tube pump A to 0.83 part/1 min and the solution transmission rate of the tube pump B to 0.11 part/1 min.

A volume average particle diameter of the obtained toner particles (5) is 5.6 μm. A toner 5 and a developer 5 are obtained in the same manner as in Example 1 except for using the toner particles (5).

Example 6

Toner particles (6) are obtained in the same manner as in the preparation of the toner particles (1) in Example 1, except for changing the solution transmission rate of the tube pump A to 0.77 part/1 min.

A volume average particle diameter of the obtained toner particles (6) is 5.9 μm. A toner 6 and a developer 6 are obtained in the same manner as in Example 1 except for using the toner particles (6).

Example 7

Toner particles (7) are obtained in the same manner as in the preparation of the toner particles (1) in Example 1, except for changing the solution transmission rate of the tube pump A to 0.74 part/1 min.

A volume average particle diameter of the obtained toner particles (7) is 5.8 μm. A toner 7 and a developer 7 are obtained in the same manner as in Example 1 except for using the toner particles (7).

Example 8

Toner particles (8) are obtained in the same manner as in the preparation of the toner particles (1) in Example 1, except for changing the added amount of the amorphous polyester resin dispersion after the formation of the second aggregated particles to 80 parts.

A volume average particle diameter of the obtained toner particles (8) is 6.2 μm. A toner 8 and a developer 8 are obtained in the same manner as in Example 1 except for using the toner particles (8).

Example 9

Toner particles (9) are obtained in the same manner as in the preparation of the toner particles (1) in Example 1, except for changing the added amount of the amorphous polyester resin dispersion after the formation of the second aggregated particles to 10 parts.

A volume average particle diameter of the obtained toner particles (9) is 5.5 μm. A toner 9 and a developer 9 are obtained in the same manner as in Example 1 except for using the toner particles (9).

Example 10

Toner particles (10) are obtained in the same manner as in the preparation of the toner particles (1) in Example 1, except for changing the white pigment dispersion 1 to the white pigment dispersion 2.

A volume average particle diameter of the obtained toner particles (10) is 5.9 μm. A toner 10 and a developer 10 are obtained in the same manner as in Example 1 except for using the toner particles (10).

Example 11

Toner particles (11) are obtained in the same manner as in the preparation of the toner particles (1) in Example 1, except for changing the amount of the white pigment dispersion 1 added to the vessel A of the polyester bottle to 20 parts, and the amount of the white pigment dispersion 2 added to the vessel B of the polyester bottle to 50 parts.

A volume average particle diameter of the obtained toner particles (11) is 6.0 μm. A toner 11 and a developer 11 are obtained in the same manner as in Example 1 except for using the toner particles (11).

Comparative Example 1

Toner particles (C1) are obtained in the same manner as in the preparation of the toner particles (1) in Example 1, except for driving the tube pumps A and B when a temperature in the round stainless steel flask during the formation of aggregating particles has reached 33° C.

A volume average particle diameter of the obtained toner particles (C1) is 5.8 μm. A toner C1 and a developer C1 are obtained in the same manner as in Example 1 except for using the toner particles (C1).

Comparative Example 2

Toner particles (C2) are obtained in the same manner as in the preparation of the toner particles (1) in Example 1, except for driving the tube pumps A and B when a temperature in the round stainless steel flask during the formation of aggregating particles has reached 41° C.

A volume average particle diameter of the obtained toner particles (C2) is 6.4 μm. A toner C2 and a developer C2 are obtained in the same manner as in Example 1 except for using the toner particles (C2).

Comparative Example 3

Toner particles (C3) are obtained in the same manner as in the preparation of the toner particles (1) in Example 1, except for changing the solution transmission rate of the tube pump A to 0.50 part/1 min and the solution transmission rate of the tube pump B to 0.18 part/1 min.

A volume average particle diameter of the obtained toner particles (C3) is 6.2 μm. A toner C3 and a developer C3 are obtained in the same manner as in Example 1 except for using the toner particles (C3).

Comparative Example 4

Toner particles (C4) are obtained in the same manner as in the preparation of the toner particles (1) in Example 1, except for changing the solution transmission rate of the tube pump A to 0.89 part/1 min and the solution transmission rate of the tube pump B to 0.08 part/1 min.

A volume average particle diameter of the obtained toner particles (C4) is 5.5 μm. A toner C4 and a developer C4 are obtained in the same manner as in Example 1 except for using the toner particles (C4).

Various Measurements

Regarding the toner obtained in each example, the maximum frequent value and the skewness in distribution of the eccentricity B of the white pigment, and the amount thereof on the surface are measured by the method described above. The results thereof are shown in Table 1.

Various evaluations are performed by the following method. The results are shown in Table 1.

Evaluation of Concealing Properties

A solid image with a toner applied amount of 12 g/m$^2$ is printed on an OHP film (OHP film for PPC laser, manufactured by Fuji Xerox Co., Ltd.) using the toner obtained in each example, and a test for concealing properties is performed according to the method of JIS K 5600-4-1. Specifically, the printed image is adhered onto a white portion and a black portion of a concealing test paper, a Y value under the D65 light source is obtained on each of the white portion and the black portion using a spectrophotometric system X-rite 938 (manufactured by X-Rite), and a value of (black portion)/(white portion)×100[%] with respect to the obtained Y values is designated as a result of the evaluation of concealing properties. The results of the evaluation are determined as follows.

A: concealing properties are equal to or greater than 80% or more

B: concealing properties are equal to or greater than 70% and less than 80%

C: concealing properties are equal to or greater than 60% and less than 70%

D: concealing properties are less than 60%

Evaluation of Laminating Properties

A solid image with a toner applied amount of 12 g/m$^2$ is printed over the entire coated sheet (OS Coat 127 gsm, manufactured by Fuji Xerox Co., Ltd.) with a margin of 2 mm at a front end by using the toner obtained in each example, and a laminate film (OPP#40 Standard Adhesion White GS manufactured by Maruu Secchaku Corporation) is laminated thereon using a laminating apparatus (LAMI M1M manufactured by KOKUYO Co., Ltd.). The front end of the laminated film is fixed using a peeling test machine (STROGRAPH VG manufactured by Toyo Seiki Seisaku-Sho, Ltd.), a force is applied in a direction forming an angle of 90° C. with the paper, a force applied while peeling is measured, a maximum value thereof is set as a result of evaluation of laminating properties. The results of the evaluation are determined as follows.

A: equal to or greater than 2N

B: equal to or greater than 1.5 N and smaller than 2.0 N

C: equal to or greater than 1.0 N and smaller than 1.5 N

D: smaller than 1.0 N

Evaluation of Gloss Uniformity

In the evaluation of laminating properties, gloss uniformity is evaluated using the image printed on the coated sheet. Specifically, the measurement is performed regarding five portions which are both ends at 1 cm portion from the front edge of the image, a center portion of the image, and both ends at 1 cm portion from the rear edge of the image by a 60° C. gloss meter (manufactured by BYK-Gardner), and a standard deviation σ of the gloss values is obtained and is designated as a result of the evaluation of the gloss uniformity. The results of the evaluation are determined as follows.

A: smaller than 1.0

B: equal to or greater than 1.0 and smaller than 3.0

C: equal to or greater than 3.0 and smaller than 5.0

D: equal to or greater than 5.0

TABLE 1

| | | Kinds of | Distribution of eccentricity of white pigment | | Surface exposure | Evaluation | | |
|---|---|---|---|---|---|---|---|---|
| | Kinds of toner | white pigment | Maximum frequent value | Skewness | proportion of white pigment (% by weight) | Concealing properties | Laminating properties | Gloss uniformity |
| Example 1 | Toner 1 | A-220 | 0.85 | −0.75 | 0.09 | A: 82% | A: 2.4 | A: 0.7 |
| Example 2 | Toner 2 | A-220 | 0.75 | −0.72 | 0.22 | B: 75% | A: 2.2 | A: 0.8 |
| Example 3 | Toner 3 | A-220 | 0.94 | −0.83 | 0.15 | A: 82% | B: 1.7 | A: 0.9 |
| Example 4 | Toner 4 | A-220 | 0.82 | −1.20 | 0.25 | A: 81% | A: 2.3 | B: 1.5 |
| Example 5 | Toner 5 | A-220 | 0.84 | −0.01 | 0.22 | A: 82% | B: 1.8 | B: 2.0 |
| Example 6 | Toner 6 | A-220 | 0.85 | −0.40 | 0.26 | A: 81% | A: 2.2 | B: 1.7 |
| Example 7 | Toner 7 | A-220 | 0.84 | −0.52 | 0.24 | A: 82% | A: 2.5 | A: 0.5 |
| Example 8 | Toner 8 | A-220 | 0.85 | −0.71 | 0.05 | B: 78% | A: 2.2 | A: 0.8 |
| Example 9 | Toner 9 | A-220 | 0.87 | −1.10 | 1.49 | A: 82% | B: 1.7 | A: 0.7 |
| Example 10 | Toner 10 | JR-301 | 0.82 | −0.74 | 0.15 | A: 83% | A: 2.3 | A: 0.6 |
| Example 11 | Toner 11 | A-220 | 0.84 | −0.80 | 0.21 | A: 85% | A: 2.1 | A: 0.7 |
| Comparative Example 1 | Toner C1 | A-220 | 0.72 | −0.75 | 0.25 | C: 68% | B: 1.6 | C: 3.5 |
| Comparative Example 2 | Toner C2 | A-220 | 0.97 | −0.74 | 0.15 | A: 81% | C: 1.1 | B: 2.1 |
| Comparative Example 3 | Toner C3 | A-220 | 0.83 | −1.25 | 0.13 | A: 82% | C: 1.2 | D: 5.2 |
| Comparative Example 4 | Toner C4 | A-220 | 0.87 | 0.20 | 0.21 | B: 73% | D: 0.9 | C: 3.6 |

Hereinabove, it is found from the results of the examples that excellent concealing properties and laminating properties of the obtained image are obtained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, comprising:

toner particles including a binder resin and a white pigment, wherein a maximum frequent value in distribution of eccentricity B of the white pigment represented by the following Expression (1) is from 0.75 to 0.95, and a skewness in the distribution of the eccentricity B is from −1.20 to 0.00:

$$\text{eccentricity } B=2d/D \qquad \text{Expression (1):}$$

wherein D represents an equivalent circle diameter (μm) of a toner particle in observation of the cross section of the toner particle, and d represents a distance (μm) from the centroid of the toner particle to the centroid of the white pigment in observation of the cross section of the toner particle.

2. The electrostatic charge image developing toner according to claim 1, wherein the skewness in the distribution of the eccentricity B is from −1.20 to −0.50.

3. The electrostatic charge image developing toner according to claim 1, wherein an amount of the white pigment present on the surface of the toner particle is from 0.05% by weight to 1.50% by weight with respect to the total amount of elements present on the surface of the toner particle.

4. The electrostatic charge image developing toner according to claim 1, wherein a value of a refractive index $R^w$ of the white pigment is from 2.00 to 2.90.

5. The electrostatic charge image developing toner according to claim 1, wherein a volume average particle diameter of the white pigment is from 100 nm to 500 nm.

6. The electrostatic charge image developing toner according to claim 1, wherein the white pigment includes titanium dioxide.

7. The electrostatic charge image developing toner according to claim 1, wherein a content of the white pigment is from 20% by weight to 60% by weight with respect to the total content of the toner particles.

8. The electrostatic charge image developing toner according to claim 1, wherein the toner particles includes a polyester resin having a glass transition temperature (Tg) of 50° C. to 80° C. as the binder resin and a release agent having a melting temperature of from 60° C. to 100° C.

9. The electrostatic charge image developing toner according to claim 1, wherein an average circularity of the toner particles is from 0.95 to 0.98.

10. The electrostatic charge image developing toner according to claim 1, wherein a volume average particle diameter of the toner particles is from 4 μm to 8 μm.

11. An electrostatic charge image developer comprising:

the electrostatic charge image developing toner according to claim 1.

12. A toner cartridge comprising:

a container that contains the electrostatic charge image developing toner according to claim 1, wherein the toner cartridge is detachable from an image forming apparatus.

* * * * *